US005378118A

United States Patent [19]

Phillips

[11] Patent Number: 5,378,118

[45] Date of Patent: Jan. 3, 1995

[54] CARTRIDGE ASSEMBLY WITH ORIFICE PROVIDING PRESSURE DIFFERENTIAL

[75] Inventor: Robert S. Phillips, Lafayette, Ind.

[73] Assignee: TRW Inc., Lyndhurst, Ohio

[21] Appl. No.: 105,797

[22] Filed: Aug. 12, 1993

[51] Int. Cl.[6] ..... F04B 49/00

[52] U.S. Cl. ..... 417/308; 137/493.4

[58] Field of Search ..... 417/308, 310; 137/116, 137/116.5, 493.4, 569

[56] References Cited

U.S. PATENT DOCUMENTS

| | | | |
|---|---|---|---|
| 3,656,870 | 4/1972 | Kusakabe et al. | 417/300 |
| 4,099,893 | 7/1978 | Coffman | 417/300 |
| 4,210,170 | 7/1980 | Sutton | 137/493.4 |
| 4,300,591 | 11/1981 | Sutton | 137/493.4 |
| 4,340,337 | 7/1982 | Bristow et al. | 417/308 |
| 4,391,569 | 7/1983 | Bristow et al. | 417/308 |
| 5,072,749 | 12/1991 | Ligh | 137/116.5 |

*Primary Examiner*—Richard A. Bertsch

*Assistant Examiner*—Alfred Basichas

*Attorney, Agent, or Firm*—Tarolli, Sundheim & Covell

[57] ABSTRACT

An improved cartridge assembly (10) is used in a pump to bypass excess fluid flow and vent excess fluid pressure. The cartridge assembly includes a housing (24) which is located in and fixedly secured to a pump body (14). An orifice (62) is disposed within the housing (24) to establish a pressure differential in a flow of fluid from an inlet (34) to the housing to an outlet (42) from the housing. A fluid bypass port (38) is formed in the housing (24). A flow control valve (66) is disposed within the housing (24) and is movable relative to the housing to control the flow of fluid through the bypass port (38). A pressure relief valve assembly (104) is disposed in the housing (24) and is operable to an open condition to vent excess fluid pressure to the bypass port (38) through passages (106 and 107) formed in the flow control valve (66). The pressure relief valve assembly (104) is connected with the flow control valve (66) and moves with the flow control valve relative to the housing (24).

15 Claims, 5 Drawing Sheets

CARTRIDGE ASSEMBLY WITH ORIFICE PROVIDING PRESSURE DIFFERENTIAL

BACKGROUND OF THE INVENTION

The present invention relates to a cartridge assembly for use in a pump to bypass excess fluid flow and vent excess fluid pressure.

A known cartridge assembly for use in a pump to bypass excess fluid flow and vent excess fluid pressure is disclosed in U.S. Pat. No. 4,099,893. The cartridge assembly disclosed in this patent cooperates with a variable orifice which is disposed outside of the cartridge assembly. The cartridge assembly has separate ports for bypassing excess fluid flow and for venting excess fluid pressure. A separate outlet connection is provided to conduct fluid flow from the pump to a system to be supplied with fluid.

Another known cartridge assembly is disclosed in U.S. Pat. No. 3,656,870. This cartridge assembly includes only a flow control valve for controlling the flow of excess fluid from the cartridge assembly. A separate bypass valve assembly is mounted in the pump outside of the cartridge assembly.

SUMMARY OF THE INVENTION

The present invention provides a new and improved cartridge assembly to bypass excess fluid flow and to vent excess fluid pressure. The cartridge assembly includes a housing in which an orifice, a flow control valve and a pressure relief valve assembly are enclosed. The orifice is effective to establish a pressure differential in a flow of fluid from an inlet to an outlet in the housing. The flow control valve is movable relative to the housing to control the flow of fluid through a bypass port in the housing. A pressure relief valve assembly is disposed in the housing to effect a reduction in the fluid pressure at the outlet from the housing.

The pressure relief valve assembly is connected with the flow control valve and is movable with the flow control valve relative to the housing. When the pressure relief valve assembly is operated to an open condition, fluid pressure is vented to the bypass port through passages in the flow control valve.

In one embodiment of the invention, the orifice for establishing a fluid pressure differential is disposed on the flow control valve. When the pressure relief valve assembly is opened, fluid pressure is vented through passages formed in the flow control valve. In a second embodiment of the invention, the orifice which establishes a pressure differential is connected directly to the housing. In this embodiment of the invention, operation of the pressure relief valve assembly also vents fluid pressure to the bypass port through passages formed in the flow control valve.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF SPECIFIC PREFERRED EMBODIMENTS OF THE INVENTION

Cartridge Assembly

Figure 1:
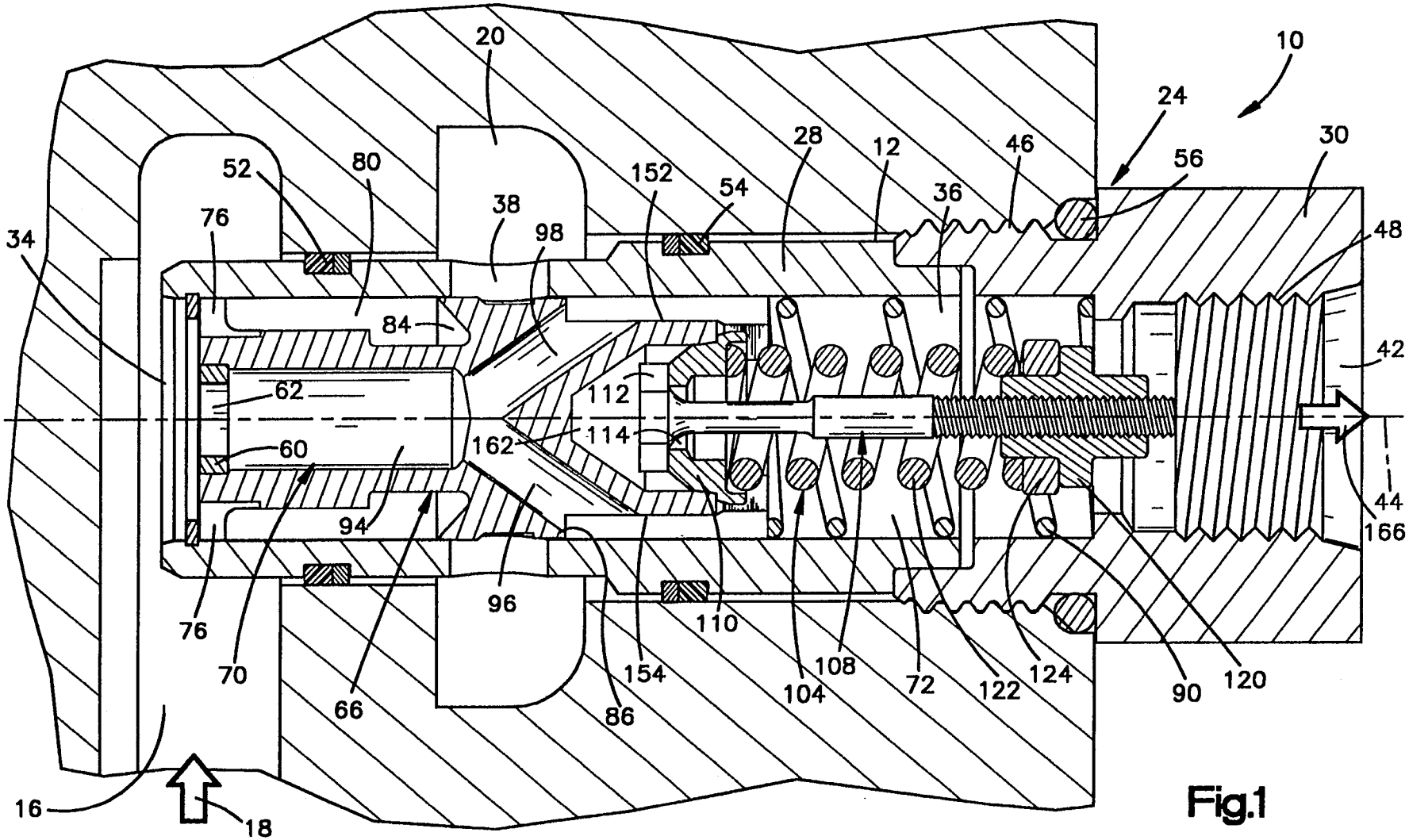
FIG. 1 is an enlarged cross-sectional view of a cartridge assembly constructed in accordance with the present invention and illustrating the relationship between a flow control valve and a pressure relief valve assembly, the pressure relief valve assembly being shown in a closed condition.

A cartridge assembly 10 (FIG. 1) is mounted in a cylindrical cavity 12 in a pump body 14. The cavity 12 is connected with a working chamber of the pump by a pump discharge chamber 16. Fluid discharged from the working chamber of the pump is conducted to the discharge chamber 16 in the manner indicated by the arrow 18 in FIG. 1. The pump may be of any known construction, such as a gear pump, slipper pump, or vane pump.

The cartridge assembly 10 bypasses excess fluid flow from the pump working chamber. In addition, the cartridge assembly 10 vents excess fluid pressure at an outlet to a system supplied with fluid by the pump. The excess fluid and the excess pressure are conducted to a pump return chamber 20. The pump return chamber 20 is connected in fluid communication with reservoir and an inlet to the working chamber of the pump.

The cartridge assembly 10 (FIG. 1) includes a housing 24 which encloses all of the components of the cartridge assembly. This enables the cartridge assembly 10 to be connected with and disconnected from the pump body 14 as a unitary assembly. The unitary construction of the cartridge assembly 10 facilitates construction of the pump and subsequent disassembly of the pump for any repairs which may be needed.

The housing 24 includes a cylindrical sleeve 28 and an outlet fitting 30. The sleeve 28 and outlet fitting 30 are fixedly interconnected by an interference fit. Of course, the sleeve 28 and outlet fitting 30 could be interconnected in a different manner if desired.

The sleeve 28 has a circular inlet 34. Relatively high pressure fluid conducted from the working chamber of the pump flows through the discharge chamber 16 into the inlet 34 to a cylindrical housing chamber 36. Excess fluid is discharged from the cartridge assembly 10 through a plurality of circular bypass ports 38 formed in the sleeve 28. In the illustrated embodiment of the invention, there are four bypass ports 38 at equally spaced locations about the periphery of the sleeve 28. Of course, a greater or lesser number of bypass ports could be provided if desired.

The outlet fitting 30 has a circular outlet 42 which is disposed at an end of the housing 24 opposite from the inlet 34. The inlet 34 and outlet 42 have central axes which are coincident with a central axis 44 of the cartridge assembly 10. The outlet fitting 30 has external threads 46 which cooperate with internal threads on the pump body 14 to interconnect the cartridge assembly 10 and pump body. In addition, the outlet fitting 30 has internal threads 48 which connect the cartridge assembly 10 with a conduit (not shown) leading to a system which is supplied with fluid by the pump.

A plurality of seals are provided to prevent leakage of fluid between the cartridge assembly 10 and pump body 14. Thus, annular seals 52 prevent leakage of fluid from the discharge chamber 16, which is at a relatively high pressure, to the pump return chamber 20, which is at a relatively low pressure. In addition, annular seals 54 prevent leakage of fluid from the pump chamber 20 along the sleeve 28. An O-ring seal 56 prevents leakage of fluid between the outlet fitting 30 and the pump body 14.

An annular ring 60 (FIG. 1) forms a circular orifice 62. Both the ring 60 and orifice 62 are located entirely within the housing 24. Fluid flow conducted from the housing inlet 34 to the outlet 42 flows through the orifice 62. The orifice 62 establishes a fluid pressure differential in the flow of fluid through the orifice. Thus, the fluid pressure at the inlet or upstream side of the orifice 62 is greater than the fluid pressure at the outlet or downstream side of the orifice.

The orifice ring 60 is fixedly secured to a flow control valve 66 disposed in the housing 24. The flow control valve 66 controls a flow of fluid from the housing chamber 36 through the bypass ports 38. Thus, if the rate of fluid flow discharged from the working chamber of the pump exceeds the demand for fluid by the system connected in fluid communication with the outlet 42, the flow control valve 66 is moved toward the right (as viewed in FIG. 1) to at least partially open the bypass ports 38. This enable excess fluid to flow from the cartridge assembly 10 to the pump return chamber 20.

A main fluid flow passage 70 extends axially through the flow control valve 66. The main fluid flow passage 70 is connected in fluid communication with the discharge chamber 16 through the inlet 34 and the orifice 62. The main flow passage 70 conducts fluid from the downstream side of the orifice 62 to an outlet end portion 72 of the housing chamber 36.

Relatively high fluid pressure is conducted from the discharge chamber 16 through slots 76 formed in the flow control valve 66 to an inlet end portion 80 of the housing chamber 36. During normal operation of the pump, the inlet end portion 80 of the housing chamber 36 is at a higher fluid pressure than the outlet end portion 72 of the chamber 36. Therefore, a left (as viewed in FIG. 1) end surface 84 of the flow control valve 70 is exposed to a higher fluid pressure than a right end surface 86 of the flow control valve 66. However, the flow control valve 66 is maintained in the closed position of FIG. 1 by a biasing spring 90.

When the rate of flow of fluid from the working chamber of the pump exceeds the demand for fluid by the system connected with the cartridge assembly 10, the fluid pressure against the left end surface 84 of the flow control valve 66 increases. When this occurs, the flow control valve 66 moves toward the right (as viewed in FIG. 1), against the influence of fluid pressure and biasing spring 90, to partially open the bypass ports 38. The greater the amount by which the output from the pump exceeds the demand for fluid by the system connected with the cartridge assembly 10, the further the flow control valve 66 is moved toward the right and the greater is the extent to which the bypass ports 38 are opened. The flow control valve 66 cooperates with the bypass ports 38 to maintain a desired rate of fluid flow to the system connected with the cartridge assembly 10.

The main fluid flow passage 70 includes a cylindrical inlet chamber 94 disposed in the flow control valve 66. The ring 60 in which the orifice 62 is formed, is disposed in the inlet chamber 94. A pair of main branch passages 96 and 98 conduct fluid flow from the inlet chamber 94 to the outlet end portion 72 of the housing chamber 36. The fluid flow is conducted from the outlet end portion 72 of the housing chamber 36 to the outlet 42 from the cartridge assembly 10.

Generally speaking, fluid flows axially through the housing 24 from the inlet 34 to the outlet 42. However, excess fluid is conducted through the bypass ports 38 to the pump return chamber 20 in a direction which is transverse to the central axis 44 of the housing 20.

A pressure relief valve assembly 104 is disposed in the housing chamber 36. The pressure relief valve assembly 104 vents excess fluid pressure at the outlet 42 through vent branch passages 106 and 107 (FIG. 2) in the flow control valve 66. The vent branch passages 106 and 107 direct the excess fluid pressure toward the bypass ports 38 and pump return chamber 20.

Both excess fluid flow and excess pressure are conducted through the bypass ports 38 to the pump return chamber 20. Excess fluid flow is conducted to the bypass ports 38 directly from the inlet end portion 80 of the housing chamber 36. Excess fluid pressure is conducted to the bypass ports 38 through the vent branch passages 106 and 107 in the flow control valve 66.

The pressure relief valve assembly 104 is mounted on and is coaxial with the flow control valve 66. The pressure relief valve assembly 104 moves with the flow control valve 66 relative to the housing 24. Thus, when the flow control valve 66 is moved toward the right from the position shown in FIG. 2 to bypass excess fluid flow from the inlet end portion 80 of the housing chamber 36, the pressure relief valve assembly 104 also moves toward the right (as viewed in FIG. 2).

The pressure relief valve assembly 104 includes a pressure relief valve member 108. The pressure relief valve member 108 is movable relative to an annular valve seat 110 which is fixedly connected, by an interference fit, with the flow control valve 66. The pressure relief valve member 108 has a head end portion 112 which engages the valve seat 110 to block fluid flow when the pressure relief valve member is in the closed position of FIG. 1.

Figure 2:
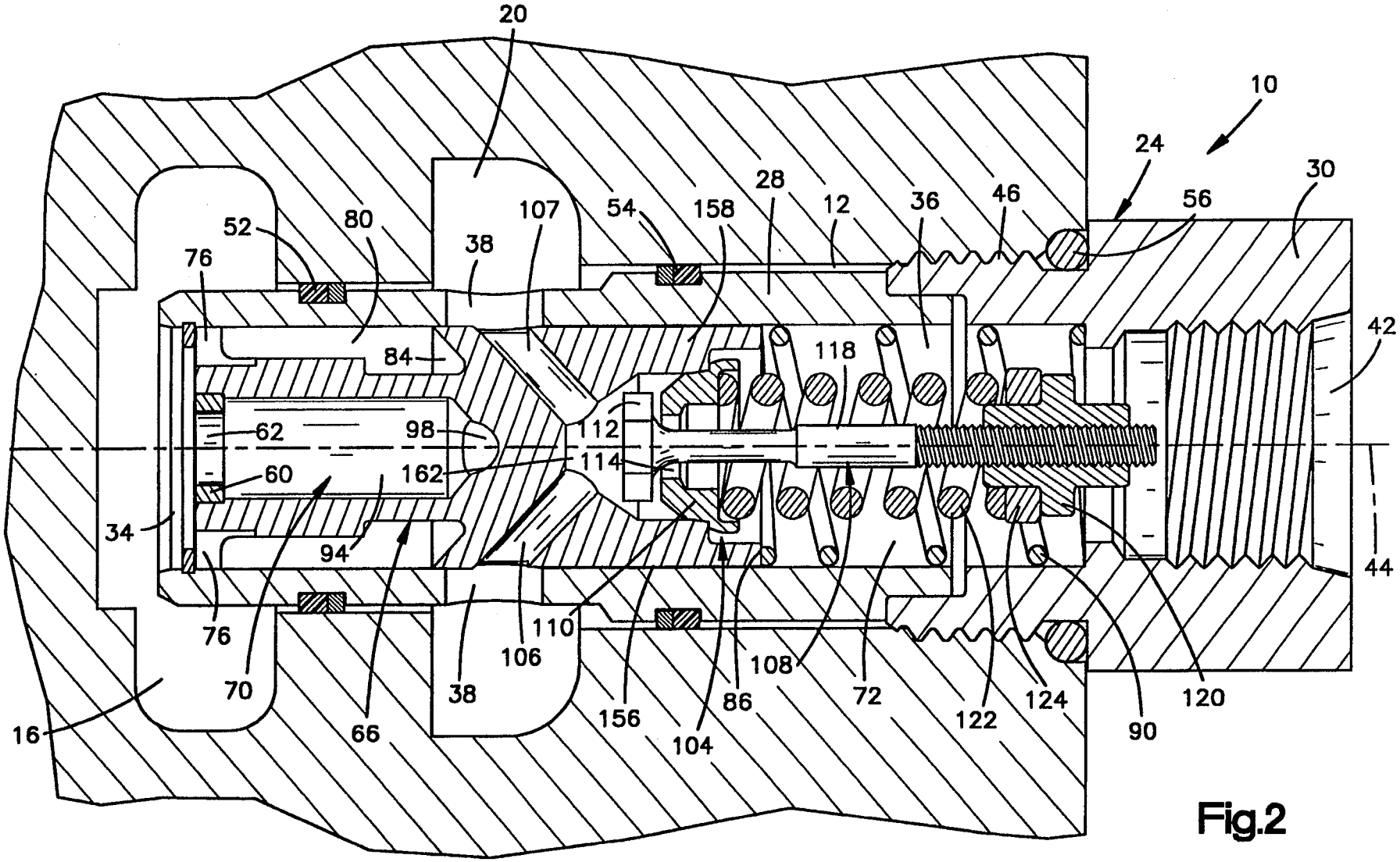
FIG. 2 is a sectional view, generally similar to FIG. 1, illustrating the pressure relief valve assembly in an open condition.
Figure 3:
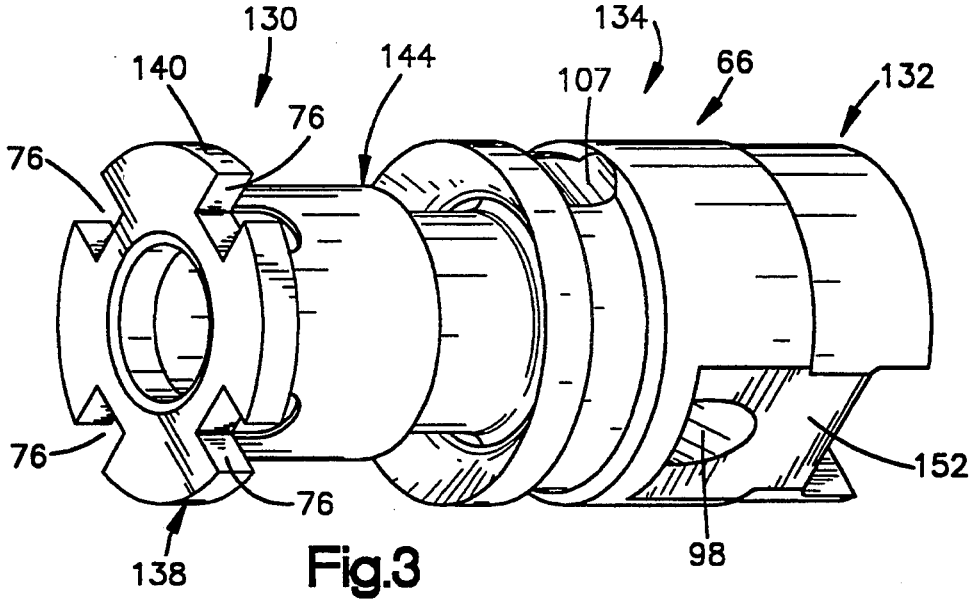
FIG. 3 is a pictorial illustration, on a reduced scale, of the flow control valve of FIG. 1.
Figure 4:
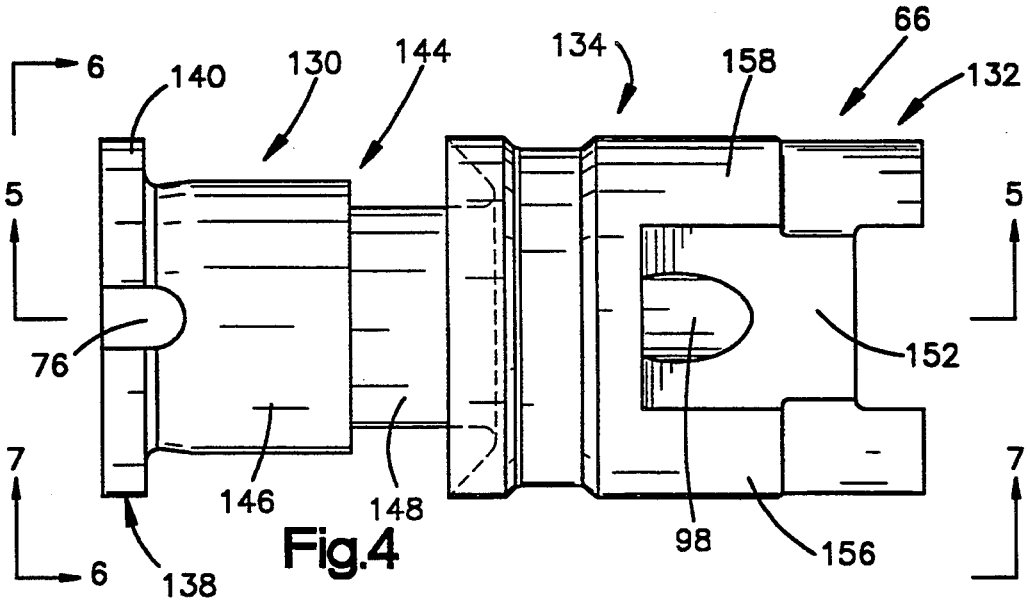
FIG. 4 is an enlarged side elevational view of the flow control valve of FIG. 3.

When the fluid pressure at the outlet end portion 72 of the housing chamber 36 exceeds a predetermined pressure, the pressure relief valve member 108 is moved from the closed position of FIG. 1 to the open position of FIG. 2. When the pressure relief valve member 108 is in the open position of FIG. 2, fluid can flow from the outlet end portion 72 of the housing chamber 36 through a circular outlet port 114 in the valve seat 110. The fluid flow is conducted from the outlet port 114 in the valve seat 110 through the vent branch passages 106 and 107 in the flow control valve 66 to the pump return chamber 20.

When the fluid pressure in the outlet end portion 72 of the housing chamber 36 has decreased to a fluid pressure which is less than the predetermined pressure, the pressure relief valve member 108 moves from the open position of FIG. 2 back to the closed position of FIG. 1. When the pressure relief valve member is in the closed position, it cooperates with the valve seat 110 to block fluid flow between the outlet end portion 72 of the housing chamber 36 and the vent branch passages 106 and 107.

The pressure relief valve member 108 has a generally cylindrical stem 118. An externally threaded end portion of the stem 118 engages an internally threaded retainer 120. A helical coil spring 122 presses an annular washer 124 against the retainer 120 to urge the pressure relief valve member 108 to the closed position of FIG. 1. However, when the fluid pressure in the outlet end portion 72 of the housing chamber 24 exceeds a predetermined fluid pressure, the fluid pressure applied against the head end portion 112 of the pressure relief valve member 108 moves the pressure relief valve member from the closed position of FIG. 1 to the open position of FIG. 2 against the influence of the spring 122.

Flow Control Valve

The one-piece flow control valve 66 (FIGS. 3–8) includes an inlet end portion 130 and an outlet end portion 132 which are interconnected by a central body portion 134. The inlet end portion 130 includes a circular head end 138 in which the slots 76 are formed. The head end 138 has a cylindrical outer side surface 140 which engages the cylindrical inner side surface of the housing chamber 36 formed in the sleeve 28 (FIGS. 1 and 2). The head end 138 of the flow control valve 66 has an annular internal recess 142 (FIG. 5) in which the orifice ring 60 (FIG. 1) is mounted.

The head end 138 (FIGS. 3 and 4) of the flow control valve 66 is connected with the central body portion 134 by a neck portion 144. The neck portion 144 has a relatively large diameter cylindrical section 146 connected with the head end 138 and a relatively small diameter cylindrical section 148 connected with the central body portion 134. The different diameter sections 146 and 148 of the neck portion 144 causes the fluid pressure conducted through the bypass ports 38 to vary or droop in a known manner when the flow control valve 66 is moved toward the right from the position shown in FIGS. 1 and 2 to enable fluid to flow through the bypass ports 38.

Figure 5:
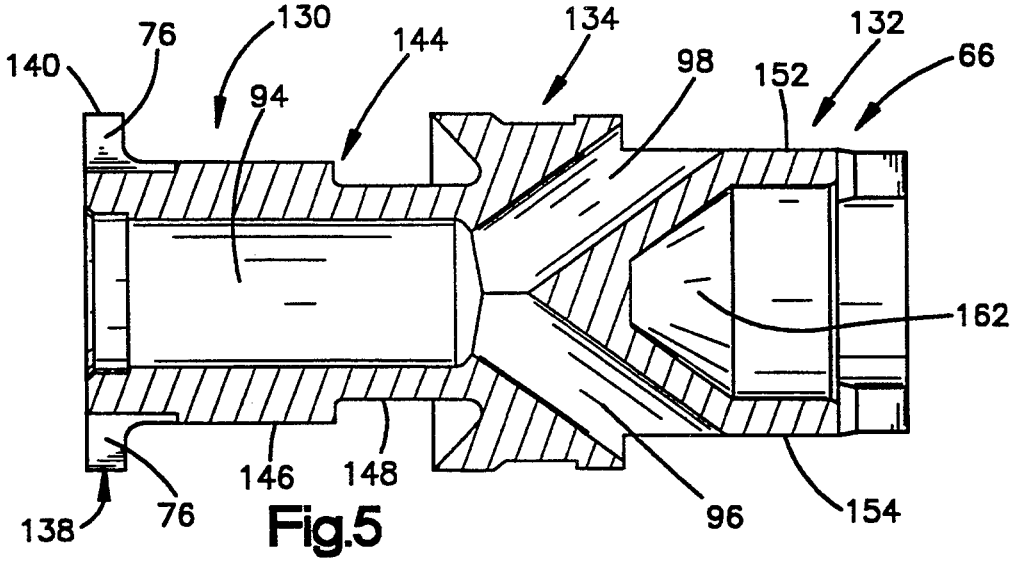
FIG. 5 is a sectional view, taken generally along the line 5—5 of FIG. 4, further illustrating the construction of the flow control valve.
Figure 6:
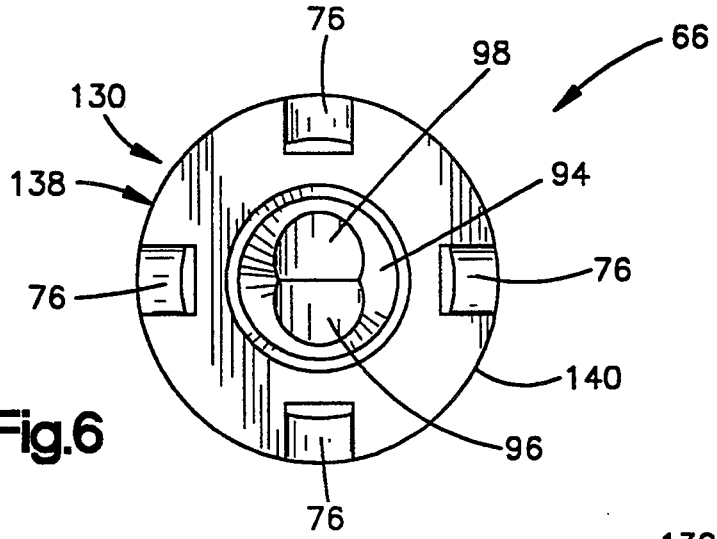
FIG. 6 is an end view, taken generally along the line 6—6 of FIG. 4.
Figure 7:
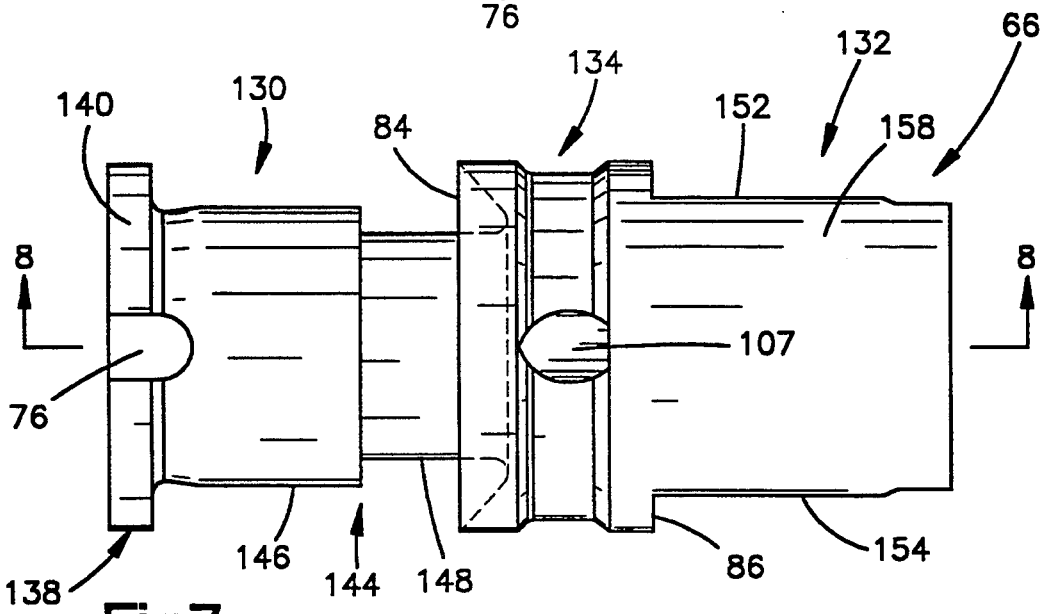
FIG. 7 is a side elevational view, taken generally along the line 7—7 of FIG. 4, further illustrating the construction of the flow control valve.
Figure 8:
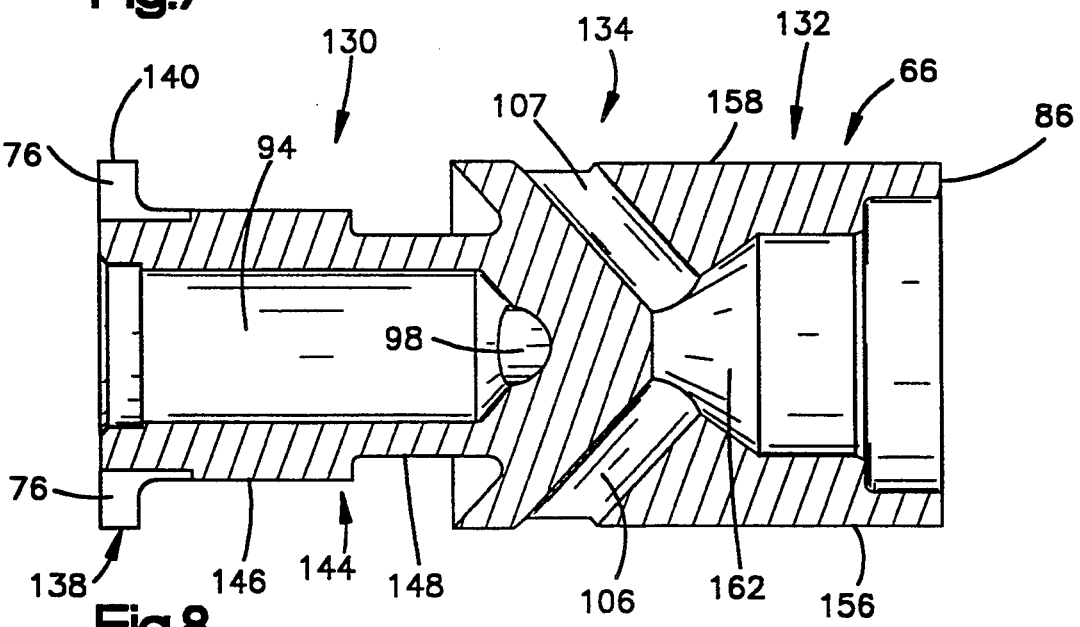
FIG. 8 is a sectional view, taken generally along the line 8—8 of FIG. 7.

The outlet end portion 132 of the flow control valve 66 has a pair of parallel flats 152 and 154 (FIG. 5). The flats 152 and 154 are cut in opposite sides of the generally cylindrical outlet portion 132. The flats 152 and 154 provide passages between the flow control valve 66 and the cylindrical inner side surface of the sleeve 28 (FIG. 1). Generally cylindrical side surface segments 156 and 158 (FIGS. 4 and 7) are disposed between the flats 152 and 154.

The central body portion 134 of the flow control valve 66 has a generally cylindrical configuration. The main branch passages 96 and 98 (FIG. 5) are formed in the central body portion 134. The main branch passages 96 and 98 extend between the inlet chamber 94 and the flats 152 and 154 on opposite sides of the flow control valve 66 (FIGS. 1 and 5).

The vent branch passages 106 and 107 (FIGS. 2 and 8) are also formed in the central body portion 134 of the flow control valve 66. The vent branch passages 106 and 107 extend from a pressure relief chamber 162 (FIG. 8) to the outer side surface of the flow control valve 66. The main branch passages 96 and 98 (FIGS. 1 and 5) are offset by 90° from the vent branch passages 106 and 107 (FIGS. 2 and 8) in the central body portion 134 of the flow control valve 66.

Operation

The cartridge assembly 10 is fixedly secured in a cavity 12 (FIGS. 1 and 2) of a pump body by the threads 46 on the outlet fitting 30. During operation of the pump, fluid flow is conducted from a working chamber of the pump to the discharge chamber 16 in the manner indicated by the arrow 18 in FIG. 1. Fluid flow is conducted from the discharge chamber 16 through the cartridge assembly 10 to a system supplied with fluid, in the manner indicated by an arrow 166 in FIG. 1.

During operation of the pump at a rate which is sufficient to supply the demand for fluid by a system connected with the cartridge assembly 10, the flow control valve 66 remains in the closed position shown in FIG. 1. At this time, the bypass ports 38 are blocked by the flow control valve 66.

Fluid flow is conducted from the discharge chamber 16 through the inlet 34 to the housing chamber 36. The fluid then flows through the orifice 62 into the inlet chamber 94 in the flow control valve. As the fluid flows through the orifice 62, a pressure differential is established in the fluid flow. Thus, the fluid pressure in the discharge chamber 16 on the upstream side of the orifice 62 will exceed the fluid pressure in the inlet chamber 94 on the downstream side of the orifice 62.

Fluid flow is conducted from the inlet chamber 94 through the main branch passages 96 and 98 (FIG. 1) to the spaces between the flats 152 and 154 and the cylindrical inner side surface of the housing chamber 36. The fluid then flows axially through the outlet end portion 72 of the housing chamber 36 to the outlet 42 from the cartridge assembly 10. A conduit (not shown), connected with the outlet fitting 30, conducts the fluid to a system to be supplied with fluid by the pump.

If the rate of flow of fluid provided by the working chamber of the pump exceeds the demand for fluid by the system connected with the cartridge assembly 10, the fluid pressure in the discharge chamber 16 will increase. The increase in fluid pressure in the discharge chamber 16 results in an increase in the fluid pressure differential created by the flow of fluid through the orifice 62. The increased fluid differential across the orifice 62 is communicated to the outlet end portion 72 of the housing chamber 36 through the main branch passages 96 and 98. This results in an increase in the fluid pressure applied against the inlet side 84 of the flow control valve 66 relative to the fluid pressure applied against the outlet side 86 of the flow control valve.

The increase in difference between the fluid pressures applied to opposite sides of the flow control valve 66 moves the flow control valve toward the right (as viewed in FIG. 1). This rightward movement of the flow control valve 66 partially unblocks the bypass ports 38. Partially opening the bypass ports 38 enables fluid to flow from the inlet end portion 80 of the housing chamber 36 through the bypass ports to the pump return chamber 20. The position of the flow control valve 66 relative to the bypass ports 38 will be such that the fluid flow requirements of the system connected with the cartridge assembly 10 are satisfied and only excess fluid flow is conducted through the bypass ports 38.

If the demand for fluid by the system connected with the cartridge assembly 10 is interrupted during operation of the pump, the fluid pressure at the system and the outlet end portion 72 of the housing chamber 36 will increase. This increased fluid pressure is applied against the head end 112 of the pressure relief valve member 108. The increased fluid pressure moves the pressure relief valve member 108 toward the left from the closed position shown in FIG. 1 to the open position shown in FIG. 2.

When the pressure relief valve member 108 is in the open position shown in FIG. 2, the excess fluid pressure is vented through the vent branch passages 106 and 107 and the bypass ports 38 to the pump return chamber 20. This results in the fluid pressure at the system being limited to a predetermined maximum pressure.

The flow control valve 66, pressure relief valve assembly 104 and the passages 96, 98, 106 and 107 for conducting fluid flow are all disposed entirely within the cartridge assembly 10. Therefore, the cartridge assembly 10 can be mounted in the pump body 14 as a unit during construction of the pump assembly. In addition, the cartridge assembly 10 can be removed from the pump body 14 as a unit during maintenance of the pump. If necessary, the cartridge assembly 10 can be readily replaced. Of course, by simplifying the construction and maintenance of the pump with which the cartridge assembly 10 is associated, the cost of constructing and maintaining the pump is reduced.

It is contemplated that the cartridge assembly 10 may be used in association with many different types of pumps which are used to supply fluid to many different types of systems. However, it is believed that the cartridge assembly 10 will be particularly advantageous when used in association with a power steering pump which is used to supply fluid pressure to a motor for turning steerable wheels of a vehicle.

Second Embodiment

Figure 9:
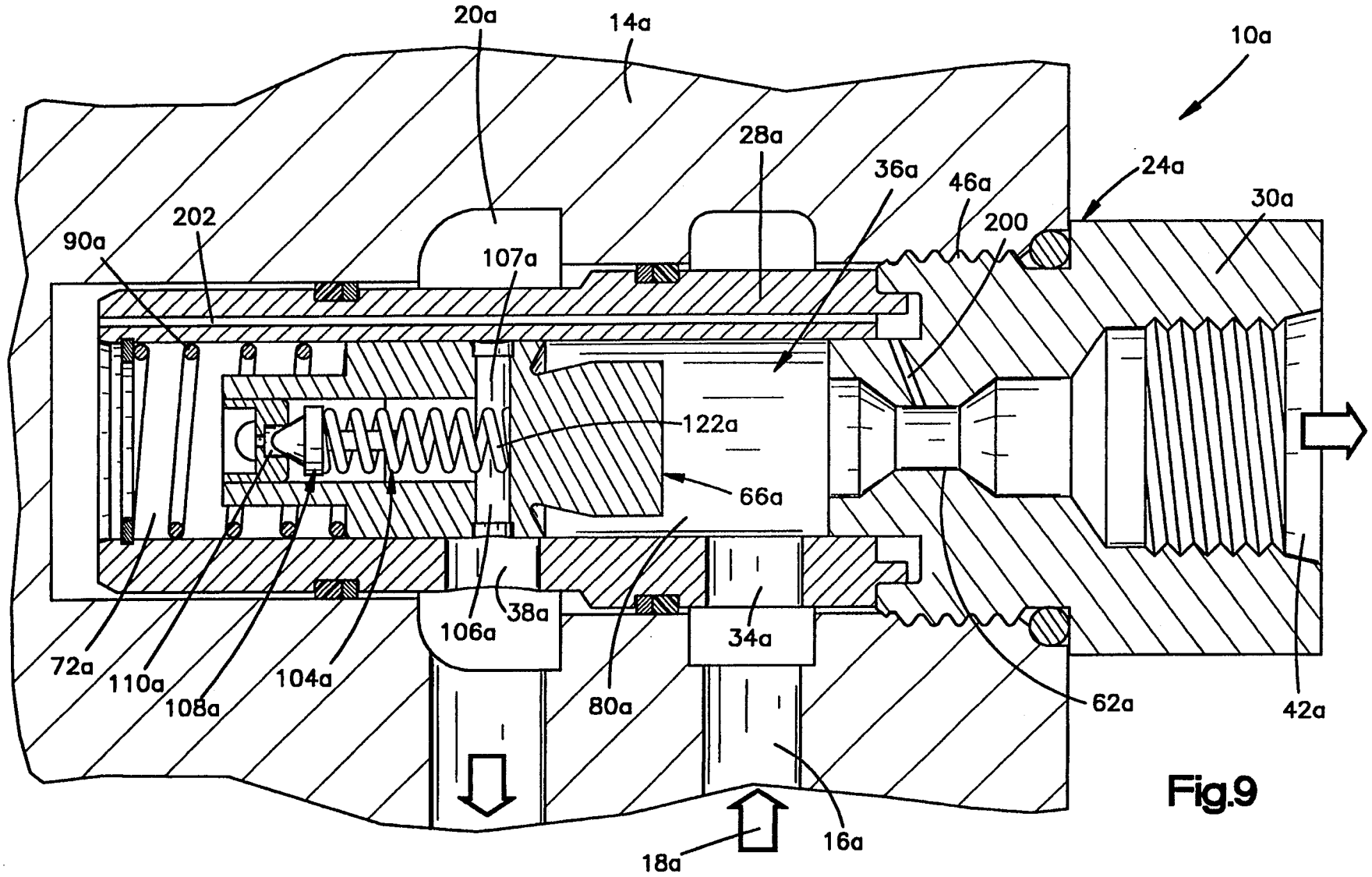
FIG. 9 is an enlarged cross-sectional view illustrating the construction of a second embodiment of the cartridge assembly.

In the embodiment of the cartridge assembly 10 illustrated in FIGS. 1–8, the main flow of fluid is axially through the cartridge assembly 10. However, it is contemplated that there are certain pump constructions which may make it advantageous to have the main flow of fluid be radially into the cartridge assembly and then axially out of the cartridge assembly. An embodiment of the cartridge assembly having this construction is illustrated in FIG. 9. Since the embodiment of the invention illustrated in FIG. 9 is generally similar to the embodiment of the invention illustrated in FIGS. 1–8, similar numerals will be utilized to designate similar components, the suffix letter "a" being associated with the embodiment of the invention illustrated in FIG. 9 to avoid confusion.

A cartridge assembly **10*a* constructed in accordance with the present invention is mounted in a pump body 14*a*. The cartridge assembly 10*a*** bypasses excess fluid flow from a pump working chamber and vents excess fluid pressure.

The cartridge assembly **10*a* includes a housing 24*a* which is mounted in the pump body 14*a*. The housing 24*a* includes a cylindrical sleeve 28*a* and an outlet fitting 30*a* which are fixedly interconnected by an interference fit. Of course, the sleeve 28*a* and outlet fitting 30*a*** could be interconnected in a different manner if desired.

During operation of the pump, fluid flow is conducted from a working chamber of the pump to a discharge chamber **16*a* in the manner indicated by the arrow 18*a* in FIG. 9. This fluid flows from the discharge chamber 16*a* through an inlet 34*a* to a cylindrical valve housing chamber 36*a*. A flow control valve 66*a* divides the housing chamber 36*a* into an inlet end portion 80*a* and a second end portion 72*a*. The fluid flows from the inlet end portion 80*a* of the housing chamber 36*a* through an orifice 62*a* to the outlet 42*a* from the cartridge assembly 10*a*. The orifice 62*a* is formed as part of the outlet fitting 30*a*. The outlet 42*a* from the cartridge 10*a*** is connected in fluid communication with a system to be supplied with fluid by the pump.

In accordance with a feature of this embodiment of the invention, fluid pressure is conducted from the orifice **62*a* through passages 200 and 202 formed in the housing 24*a* to the second end portion 72*a* of the housing chamber 36*a*. Thus, the passage 200 is formed in the outlet fitting 30*a* and the passage 202 is formed in the side wall of the cylindrical sleeve 28*a*. The passage 202 extends parallel to a longitudinal central axis of the sleeve 28*a* and the cartridge assembly 10*a***.

The flow control valve **66*a* is urged toward the closed position shown in FIG. 9 by a biasing spring 90*a* and the fluid pressure conducted from the orifice 62*a* through the passages 200 and 202. When the flow control valve 66*a* is in the closed position, the flow control valve blocks fluid flow through bypass ports 38*a***.

The orifice **62*a* establishes a pressure differential between the inlet chamber 16*a* and the outlet 42*a* from the cartridge assembly 10*a*. Thus, the fluid pressure is higher on the upstream side of the orifice 62*a* than it is at the throat of the orifice. Therefore, fluid pressure conducted through the passages 200 and 202 to the second end portion 72*a* of the housing chamber 36*a* is less than the fluid pressure at the inlet portion 80*a* of the housing chamber 36*a***.

When the fluid flow from the working chamber of the pump exceeds the demand for fluid by the system connected with the cartridge assembly **10*a*, the fluid pressure on the upstream side of the orifice 62*a* and the inlet portion 80*a* of the housing chamber 36*a* increases. This results in the flow control valve 66*a* being moved toward the left (as viewed in FIG. 9) to at least partially unblock the bypass ports 38*a*. The excess fluid flow is then conducted through the bypass ports 36*a* to the pump return chamber 20*a*. The pump return chamber 20*a*** is connected in fluid communication with the inlet to the working chamber of the pump through a reservoir.

A pressure relief valve assembly **104*a* is disposed in the housing chamber 36*a*. The pressure relief valve assembly 104*a* is disposed on the flow control valve 66*a* for movement therewith relative to the housing 24*a* and orifice 62*a*. The pressure relief valve assembly 104*a* includes a valve member 108*a* which engages a valve seat 110*a*** to block fluid flow during normal pump operating conditions.

If the fluid pressure at the outlet **42*a* exceeds a predetermined fluid pressure, this relatively high fluid pressure is conducted through the passages 200 and 202 to the second end portion 72*a* of the housing chamber 36*a*. The relatively high fluid pressure moves the pressure relief valve member 108*a* from the closed position shown in FIG. 9 to an open position against the influence of a helical coil spring 122*a*. When the pressure relief valve member 108*a* is in the open position, it is spaced from the valve seat 110*a* and fluid can flow through the valve seat to vent branch passages 106*a*** and 107*a* formed in the flow control valve 66*a*. The fluid flow vented through the open pressure relief valve assembly 104*a* is conducted from the vent branch passages 106*a* and 107*a* through the bypass ports 38*a* to the pump return chamber 20*a*.

In the embodiment of the invention illustrated in FIG. 9, the passage 202 is formed in the side wall of the sleeve 28*a*. This results in the cartridge assembly 10*a* being a self-contained unit which is readily installed in the pump body 14*a*. However, the passage 202 could be formed in the pump body 14*a* if desired.

From the above description of the invention, those skilled in the art will perceive improvements, changes and modifications. Such improvements, changes and modifications within the skill of the art are intended to be covered by the appended claims.

Having described the invention, the following is claimed:

1. A cartridge assembly for use in a pump, said cartridge assembly comprising:

a housing to be secured to the pump, said housing including surface means for defining a fluid inlet through which fluid from a working chamber of the pump enters said cartridge assembly and surface means for defining a fluid outlet through which fluid flows from said cartridge assembly to a system to be supplied with fluid by the pump;

orifice means disposed in said housing and connected in fluid communication with said fluid inlet and said fluid outlet for establishing a pressure differential in fluid flow from said fluid inlet to said fluid outlet;

a fluid bypass port formed in said housing to conduct excess fluid flow from said cartridge assembly;

flow control valve means disposed in and movable relative to said housing for controlling fluid flow through said bypass port, said flow control valve means being movable relative to said housing in response to changes in the fluid pressure differential established by said orifice means to vary the rate of fluid flow through said bypass port; and pressure relief valve means disposed in said housing for effecting a reduction in the fluid pressure at said fluid outlet, said pressure relief valve means being connected with said flow control valve means for movement therewith relative to said housing, said pressure relief valve means being operable from a closed condition blocking fluid flow to an open condition under the influence of fluid pressure in excess of a predetermined fluid pressure at said fluid outlet.

2. A cartridge assembly as set forth in claim 1 wherein said flow control valve means includes passage means for conducting fluid flow from said pressure relief valve means to said bypass port when said pressure relief valve means is in the open condition.

3. A cartridge assembly as set forth in claim 2 wherein said flow control valve means includes first surface means exposed to a relatively high fluid pressure conducted from said fluid inlet and second surface means exposed to a relatively low fluid pressure conducted from said orifice means through passage means disposed entirely within said housing.

4. A cartridge assembly as set forth in claim 3 wherein said housing includes a side wall which encloses said flow control valve means, at least a portion of said passage means for conducting a relatively low fluid pressure from said orifice means being disposed in said side wall of said housing.

5. A cartridge assembly as set forth in claim 3 wherein at least a portion of said passage means for conducting a relatively low fluid pressure from said orifice means is disposed in said flow control valve means.

6. A cartridge assembly as set forth in claim 1 wherein said orifice means is connected with said flow control valve means for movement therewith relative to said housing.

7. A cartridge assembly as set forth in claim 1 wherein said orifice means is fixedly connected with said housing and said flow control valve means is movable relative to said orifice means.

8. A cartridge assembly as set forth in claim 1 wherein said flow control valve means includes first passage means for conducting fluid flow away from said orifice means toward said fluid outlet and second passage means for conducting fluid flow away from said outlet toward said bypass port when said pressure relief valve means is in the open condition.

9. A cartridge assembly as set forth in claim 1 wherein said housing includes first passage means for conducting fluid flow away from said orifice means toward said fluid outlet, said flow control valve means including second passage means for conducting fluid flow away from said outlet toward said bypass port when said pressure relief valve means is in the open condition.

10. A cartridge assembly for use in a pump, said cartridge assembly comprising:

a housing to be secured to the pump, said housing including surface means for defining a fluid inlet through which fluid from a working chamber of the pump enters said cartridge assembly and surface means for defining a fluid outlet through which fluid flows from said cartridge assembly to a system to be supplied with fluid by the pump;

orifice means disposed in said housing and connected in fluid communication with said fluid inlet and said fluid outlet for establishing a pressure differential in fluid flow from said fluid inlet to said fluid outlet;

a fluid bypass port formed in said housing to conduct excess fluid flow from said cartridge assembly;

flow control valve means disposed in and movable relative to said housing for controlling fluid flow through said bypass port, said flow control valve means being movable relative to said housing in response to changes in the fluid pressure differential established by said orifice means to vary the rate of fluid flow through said bypass port; and pressure relief valve means disposed in said housing for effecting a reduction in the fluid pressure at said fluid outlet, said pressure relief valve means being operable from a closed condition blocking fluid flow to an open condition under the influence of fluid pressure in excess of a predetermined fluid pressure at said fluid outlet, said flow control valve means including passage means for conducting fluid flow from said pressure relief valve means to said bypass port when said pressure relief valve means is in the open condition.

11. A cartridge assembly as set forth in claim 10 wherein said flow control valve means includes first surface means exposed to a relatively high fluid pressure conducted from said fluid inlet and second surface means exposed to a relatively low fluid pressure conducted from said orifice means through second passage means disposed entirely within said housing.

12. A cartridge assembly as set forth in claim 11 wherein said housing includes a side wall which encloses said flow control valve means, at least a portion of said second passage means is disposed in said side wall of said housing.

13. A cartridge assembly as set forth in claim 10 wherein at least a portion of said passage means for conducting a relatively low fluid pressure from said orifice means is disposed in said flow control valve means.

14. A cartridge assembly as set forth in claim 10 wherein said orifice means is connected with said flow control valve means for movement therewith relative to said housing.

15. A cartridge assembly as set forth in claim 10 wherein said orifice means is fixedly connected with said housing and said flow control valve means is movable relative to said orifice means.

* * * * *